US009548194B2

(12) United States Patent
Giles et al.

(10) Patent No.: US 9,548,194 B2
(45) Date of Patent: Jan. 17, 2017

(54) TOROIDAL TRAPPING GEOMETRY PULSED ION SOURCE

(71) Applicant: Micromass UK Limited, Wilmslow (GB)

(72) Inventors: Kevin Giles, Stockport (GB); Martin Raymond Green, Bowdon (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/774,746

(22) PCT Filed: Mar. 10, 2014

(86) PCT No.: PCT/GB2014/050704

§ 371 (c)(1),
(2) Date: Sep. 11, 2015

(87) PCT Pub. No.: WO2014/140546

PCT Pub. Date: Sep. 18, 2014

(65) Prior Publication Data

US 2016/0027632 A1 Jan. 28, 2016

(30) Foreign Application Priority Data

Mar. 13, 2013 (EP) ..... 13159070
Mar. 13, 2013 (GB) ..... 1304528.1

(51) Int. Cl.
*H01J 49/00* (2006.01)
*H01J 49/42* (2006.01)
*H01J 49/40* (2006.01)

(52) U.S. Cl.
CPC ..... *H01J 49/423* (2013.01); *H01J 49/40* (2013.01); *H01J 49/427* (2013.01); *H01J 49/4295* (2013.01)

(58) Field of Classification Search
USPC ..... 250/281, 282
See application file for complete search history.

(56) References Cited

U.S. PATENT DOCUMENTS 6,872,938 B2 3/2005 Makarov et al.
7,425,699 B2 9/2008 Makarov et al.
(Continued)

FOREIGN PATENT DOCUMENTS

CN 101364519 2/2009
CN 101369510 2/2009

OTHER PUBLICATIONS

Austin et al., "*Halo Ion Trap Mass Spectrometer*", Analytical Chemistry, vol. 79, No. 7, pp. 2927-2932, 2007.

*Primary Examiner* — Nicole Ippolito
*Assistant Examiner* — Hanway Chang
(74) *Attorney, Agent, or Firm* — Diederiks & Whitelaw, PLC

(57) ABSTRACT

An ion trap is disclosed comprising: a plurality of electrodes which define a toroidal or annular ion confining volume that extends around a central axis; a first device arranged and adapted to apply one or more DC voltages to said plurality of electrodes in order to generate a DC potential well which acts to confine ions in a radial direction within said toroidal or annular ion confining volume, wherein said radial direction is substantially perpendicular to said central axis; and a control system arranged and adapted to non-mass selectively eject ions from said toroidal or annular ion confining volume. The ion trap enables a large number of ions to be trapped and ejected simultaneously.

20 Claims, 3 Drawing Sheets

(56) References Cited

U.S. PATENT DOCUMENTS

| | | | |
|---|---|---|---|
| 7,718,959 | B2 | 5/2010 | Franzen et al. |
| 8,507,852 | B2 | 8/2013 | Makarov |
| 8,946,626 | B2 | 2/2015 | Giles et al. |
| 9,035,246 | B2 | 5/2015 | Green et al. |
| 9,082,604 | B2 | 7/2015 | Verenchikov et al. |
| 2010/0320376 | A1 | 12/2010 | Makarov et al. |
| 2014/0312222 | A1 | 10/2014 | Giles et al. |
| 2014/0353487 | A1 | 12/2014 | Giles et al. |

TOROIDAL TRAPPING GEOMETRY PULSED ION SOURCE

CROSS-REFERENCE TO RELATED APPLICATION

This application is the National Stage of International Application No. PCT/GB2014/050704, filed 10 Mar. 2014 which claims priority from and the benefit of United Kingdom patent application No. 1304528.1 filed on 13 Mar. 2013 and European patent application No. 13159070.5 filed 13 Mar. 2013. The entire contents of these applications are incorporated herein by reference.

BACKGROUND OF THE PRESENT INVENTION

The present invention relates to an ion trap, a reaction or fragmentation device, a mass spectrometer, a method of mass spectrometry, a toroidal ion trap and a method of trapping ions.

U.S. Pat. No. 6,872,938 and U.S. Pat. No. 7,425,699 each disclose a method of introducing ions into an electrostatic ion trap or mass analyser. A storage device is provided comprising a curved RF confined rod set known as a C-trap in which ions are trapped by application of trapping voltages at the entrance and exit ends. However, the C-trap suffers from the problem of having a limited trapping capacity due to space charge effects. This restricts the performance of the downstream electrostatic ion trap or mass analyser.

WO 2013/027054 discloses, in relation to FIGS. 11A and 11B, an ion trap mass analyser that traps ions in a toroidal DC potential well. Ions are mass selectively ejected from the device in a radial direction. More specifically, an excitation field is applied to the device so as to excite ions of a particular mass to charge ratio out of the DC potential well and radially inwards towards the centre of the device. The excitation field is then varied so as to mass selectively eject ions of a different mass to charge ratio. However, as the device is specifically configured to mass selectively eject ions of a specific mass to charge ratio at any given time, the device is unable to simultaneously eject a large ion population of ions having a range of mass to charge ratios. The device is therefore unable fully exploit the large trapping volume that the toroidal trapping region provides, because the large ion population cannot be ejected simultaneously. Furthermore, as the ions must be excited out of the DC potential well in order to be ejected from the ion trap, this may complicate the downstream trapping or processing of the ions ejected from the trap.

Daniel E. Austin et al. "Halo Ion Trap Mass Spectrometer", Analytical Chemistry, vol. 79, no. 7, 1 Apr. 2007, pages 2927-2932 also discloses a toroidal ion trap mass analyser from which ions are mass selectively ejected in a radial direction. A toroidal trapping field is arranged in the device by applying different RF voltages to the electrodes (see introduction; and page 2929, right column, first paragraph). An RF excitation field is applied to the device so as to mass selectively eject the ions out of the toroidal trapping field and towards a detector (see page 2929, right column, first paragraph; and the paragraph spanning the two columns on page 2931). Accordingly, this device suffers from the same problems as those described above with respect to WO 2013/027054. Additionally, the device is complicated by the use of RF voltages to form both the toroidal trapping region and also the ejection field.

It is therefore desired to provide an improved ion trap, spectrometer and method of spectrometry.

SUMMARY OF THE PRESENT INVENTION

According to a first aspect the present invention there is provided an ion trap comprising:

a plurality of electrodes which define a toroidal or annular ion confining volume that extends around a central axis;

a first device arranged and adapted to apply one or more DC voltages to said plurality of electrodes in order to generate a DC potential well which acts to confine ions in a radial direction within said toroidal or annular ion confining volume, wherein said radial direction is substantially perpendicular to said central axis; and a control system arranged and adapted to non-mass selectively eject ions from said toroidal or annular ion confining volume.

In contrast to arrangements described above in WO 2013/027054 and Austin et al., the present invention non-mass selectively ejects ions from the toroidal or annular ion confining volume. As such, ions of different mass to charge ratios can be simultaneously ejected from the ion trap of the present invention. The device is therefore able to eject a large ion population substantially instantaneously and may therefore fully exploit the large trapping volume that the toroidal trapping region provides. For example, a large ion population may be ejected substantially instantaneously into a downstream device such a mass or ion mobility analyser, ion guide or ion trapping device.

Said DC potential well may confine ions in a direction having a component in the radial direction; or said DC potential well confines ions only, or purely, in the radial direction.

According to a second aspect the present invention provides an ion trap comprising:

two substantially parallel arrays of electrodes which are spaced apart so as to define a toroidal or annular ion confining volume therebetween;

a device arranged and adapted to apply one or more DC voltages to said electrodes in order to generate a DC potential well which acts to confine ions within said toroidal or annular ion confining volume in a direction that is substantially parallel to said arrays, wherein each array comprises a plurality of electrodes arranged between two edges of the array, and wherein said DC potential well acts to confine ions in a direction between said two edges of each array; and a control system arranged and adapted to non-mass selectively eject ions from said toroidal or annular ion confining volume.

The electrodes in each array of electrodes may be arranged in side-by side arrangement between two edges of the array, wherein the electrodes are arranged parallel to the two edges of the array or extending in a direction between the two edges of the array.

Said arrays of electrodes define a toroidal or annular ion confining volume that extends around a central axis of the device, and said two edges of each array are preferably a radially inner edge and a radially outer edge.

The ion trap preferably comprises a device for applying one or more RF or AC voltages to said electrodes in order to confine ions in a direction extending substantially perpendicular to each of said arrays of electrodes and in a direction extending between said arrays of electrodes.

Preferably, each of the arrays of electrodes is substantially flat or planar.

One and/or the other of the arrays of electrodes is preferably annular, circular or disc shaped.

One and/or the other of the arrays of electrodes may be a curved, tubular or conical structure.

Each of the parallel arrays of electrodes may be tubular or conical and one of the arrays of electrodes may be arranged concentrically within the other array of electrodes so as to define said toroidal or annular ion confining volume therebetween.

The central axes of the tubular or conical arrays are preferably coaxial and the ion trap comprises a device for applying one or more RF or AC voltages to said electrodes in order to confine ions in a direction extending substantially radially from said central axes.

Each array of electrodes preferably has a central axis and two edges, and said two edges are arranged at different locations along the central axis.

The central axes of the tubular or conical arrays are preferably coaxial and said DC potential well acts to confines ions in a direction extending along said central axes.

The tubular or conical arrays preferably taper from a wider end to a narrower end, and ions are preferably ejected from said ion confining volume in a direction that is substantially perpendicular to a direction extending from one of said arrays to the other of said arrays, and in a direction that is from said wider end to said narrower end.

Ions are preferably ejected from said ion confining volume in a direction that is substantially perpendicular to a direction extending from one of said arrays to the other of said arrays.

Said DC potential well preferably acts to confine ions within said toroidal or annular ion confining volume in a direction that is substantially perpendicular to a direction extending from one said arrays to the other of said arrays.

Said plurality of electrodes, or said arrays of electrodes, preferably define a toroidal or annular ion confining volume that extends around a central axis of the device, and said DC potential well may act to confine ions in a direction extending radially from said central axis.

Said plurality of electrodes, or each array of electrodes, preferably comprises a plurality of closed loop, circular, annular, oval, elliptical or spiral electrodes.

The plurality of electrodes, or the electrodes in each array, preferably extend around a common central axis.

As discussed above, the toroidal or annular trapping region may extend around a central axis and the different ones of the plurality of electrodes may be arranged at different distances from the central axis.

In the embodiments wherein the arrays of electrodes are tubular or conical, the closed loop, annular, circular, oval or elliptical electrodes are preferably displaced from each other along the central axis of each tubular or conical array.

Said control system non-mass selectively ejects ions through an exit of the ion trap, preferably by removing said DC potential well, or removing a portion of the DC potential well between the ions and the exit, and then applying one or more electrical potentials to electrodes that drive the ions out of said ion confining volume and out of said exit. Said one or more electrical potentials preferably form a DC potential gradient that drives the ions out of the exit. The one or more electrical potentials that drive the ions out of said exit form an ion extraction field. These potentials are preferably applied to said plurality of electrodes, or to said arrays of electrodes. The ion extraction field is preferably a DC extraction field.

The extraction field preferably drives ions radially inwards towards the central axis of the device, i.e. at least a component of the motion of the ejected ions is towards the central axis.

Preferably, substantially all ions within the ion trap are ejected from the ion trap at substantially the same time or in the same ion ejection pulse; and/or ions having a range of different mass to charge ratios are ejected from the ion trap at substantially the same time or in the same ion ejection pulse; and/or ions having a range of different mass to charge ratios are ejected from the ion trap at substantially the same time or in the same ion ejection pulse, wherein the ratio of the maximum mass to charge ratio ejected to the minimum mass to charge ratio ejected is selected from: >1.1; >1.2; >1.4; >1.6; >1.8; >2; >2.5; >3; >4; >5; or >10.

The ions ejected from the ion trap are preferably directed into a downstream ion guide, ion trap, mass or ion mobility analyser; or are directed onto a detector.

Said control system is preferably arranged and adapted to eject ions from said toroidal or annular ion confining volume so that said ions are focused to an ion volume which is smaller than said toroidal or annular ion confining volume.

The toroidal or annular trapping region extends around a central axis, and said control system is preferably arranged and adapted to cause ions which have been non-mass selectively ejected from said toroidal or annular ion confining volume to emerge axially from said ion trap along said central axis. One or more deflection electrodes and/or one or more extraction electrodes may be arranged to cause ions to exit the ion trap along said central axis. The ions preferably exit the ion trap only in one direction along the central axis.

The toroidal or annular trapping region is preferably arranged in a first plane, and said one or more deflection electrodes may be arranged on one side of said first plane and/or said one or more extraction electrodes may be arranged on the other side of said first plane.

The deflection electrode preferably repels ions and the extraction electrode preferably attracts ions.

The plurality of electrodes preferably comprises a first and/or second array of electrodes.

The first and/or second array of electrodes may comprises an array of circular, elliptical, curved or spiral electrodes.

The plurality of electrodes preferably comprise a first and/or second array of electrodes, and the first and/or second array of electrodes may comprises a central aperture. Optionally, the ions are ejected out of the ion trap and are subsequently directed through one or both of the apertures.

Said first array of electrodes is preferably arranged in a first plane and said second array of electrodes is preferably arranged in a second plane, wherein said first and second planes are preferably substantially parallel.

The toroidal or annular ion confining volume is preferably formed between said first and second array of electrodes.

The plurality of electrodes preferably comprises a first and/or second array of electrodes that extend around a central axis. The ion trap may further comprise a device arranged and adapted to apply a RF voltage to said first and/or second array of electrodes in order to generate a pseudo-potential well which acts to confine ions within said ion trap in an axial direction along the central axis.

The plurality of electrodes preferably comprises a first and/or second array of electrodes, and said device may be arranged and adapted to apply a DC voltage to said first and/or second arrays of electrodes in order to generate said DC potential well which acts to confine ions in the radial direction.

The plurality of electrodes preferably comprises a first and second array of electrodes, wherein said first array of electrodes is arranged in a first inner conical arrangement and said second array of electrodes is arranged in a second outer conical arrangement. Said toroidal or annular ion confining volume may be formed between said first inner conical arrangement and said second outer conical arrangement.

The ion trap may comprise one or more deflection electrodes and/or one or more extraction electrodes arranged to eject ions from an annular region of said ion trap.

The ion trap preferably comprises a device arranged and adapted to apply a RF voltage to said first and/or second array of electrodes in order to generate a pseudo-potential well which acts to confine ions in a direction substantially perpendicular to the surface of said first inner conical arrangement and/or substantially perpendicular to the surface of said second outer conical arrangement within said ion trap.

The control system is preferably arranged and adapted to extract ions from said ion trap by either: (i) reducing or altering the amplitude of a DC and/or RF voltage applied to said plurality of electrodes; and/or (ii) lowering, removing or altering a DC potential well or a pseudo-potential well; and/or (iii) changing a DC potential well to an extractive DC potential.

The device is preferably arranged and adapted to apply a DC voltage to said first and/or second arrays of electrodes in order to generate the DC potential well which acts to confine ions in a direction parallel to the surface of said first inner conical arrangement and/or parallel to the surface of said second outer conical arrangement within said ion trap.

The DC potential well may be substantially symmetrical, quadratic or asymmetrical. For example, the well may be symmetrical or quadratic during ion trapping and may be asymmetrical during ion injection or ejection.

During an ejection mode of operation, ions ejected from said ion trap are preferably caused to separate according to their mass, mass to charge ratio or time of flight.

Ions may be ejected from said ion trap in a direction which is substantially orthogonal to the plane of the toroidal or annular ion confining volume.

Preferably, ions are confined as a torus within said toroidal or annular ion confining volume with a radius r1 and are ejected as a beam of ions with a radius r2, wherein $r2<r1$.

The control system is preferably arranged and adapted: (i) to pulse a DC electric field in order to cause ions to be ejected from said ion trap; and/or (ii) to apply one or more DC extraction potentials to said ion trap in order to cause ions to be ejected from said ion trap.

The present invention also provides a reaction or fragmentation device comprising an ion trap as described herein.

The present invention also provides a mass and/or ion mobility spectrometer comprising an ion trap or a reaction or fragmentation device as described herein.

The spectrometer may further comprise an ion-optical device arranged downstream of said ion trap; wherein said control system is configured to eject ions from said ion trap into said ion-optical device.

The ion-optical device may comprise: a Time of Flight mass analyser; an ion mobility spectrometer or separator; a mass analyser; an electrostatic ion trap or mass analyser; an ion trap; or an ion guide.

The present invention also provides a method of mass and/or ion mobility spectrometry comprising:

trapping ions in a toroidal or annular ion confining volume that extends around a central axis;

generating a DC potential well which acts to confine ions in a radial direction within said toroidal or annular ion confining volume, wherein said radial direction is substantially perpendicular to said central axis; and non-mass selectively ejecting ions from said toroidal ion confining volume.

The method may comprise ejecting ions from said toroidal or annular ion confining volume so that said ions are focused to an ion volume which is smaller than said toroidal or annular ion confining volume.

The method may comprise causing ions which have been non-mass selectively ejected from said toroidal or annular ion confining volume to emerge axially from said ion trap.

The method may comprise: providing a first array of electrodes wherein said first array of electrodes comprises an array of circular, elliptical, curved or spiral electrodes and wherein optionally said first array of electrodes comprises a central aperture; and providing a second array of electrodes wherein said second array of electrodes comprises an array of circular, elliptical, curved or spiral electrodes and wherein optionally said second array of electrodes comprises a central aperture; wherein said first array of electrodes is arranged in a first plane and said second array of electrodes is arranged in a second plane, and wherein said first and second planes are substantially parallel; and wherein said toroidal ion confining volume is formed between said first and second array of electrodes.

The method may comprise providing one or more deflection electrodes and/or one or more extraction electrodes arranged to eject ions from a central region.

The method preferably comprises applying a RF voltage to said first and/or second arrays of electrodes in order to generate a pseudo-potential well which acts to confine ions in an axial direction.

The method may comprise extracting ions from said toroidal or annular ion confining volume by either: (i) reducing or altering the amplitude of a DC and/or RF voltage; and/or (ii) lowering, removing or altering a DC potential well or a pseudo-potential well; and/or (iii) changing a DC potential well to an extractive DC potential.

The method preferably comprises applying a DC voltage to said first and/or second arrays of electrodes in order to generate a DC potential well which acts to confine ions in a radial direction.

The DC potential well is preferably substantially symmetrical, quadratic or asymmetrical.

The method may comprise: providing a first array of electrodes wherein said first array of electrodes comprises an array of circular, elliptical, curved or spiral electrodes and wherein optionally said first array of electrodes comprises a central aperture; and providing a second array of electrodes wherein said second array of electrodes comprises an array of circular, elliptical, curved or spiral electrodes and wherein optionally said second array of electrodes comprises a central aperture; and wherein said first array of electrodes is arranged in a first inner conical arrangement and said second array of electrodes is arranged in a second outer conical arrangement.

The toroidal or annular ion confining volume is preferably formed between said first inner conical arrangement and said second outer conical arrangement.

The method may comprise providing one or more deflection electrodes and/or one or more extraction electrodes to eject ions from an annular region.

The method preferably comprises applying a RF voltage to said first and/or second arrays of electrodes in order to generate a pseudo-potential well which acts to confine ions in a direction substantially perpendicular to the surface of said first inner conical arrangement and/or substantially perpendicular to the surface of said second outer conical arrangement.

The method may comprise comprising extracting ions from said toroidal ion confining volume by either: (i) reducing or altering the amplitude of a DC and/or RF voltage; and/or (ii) lowering, removing or altering a DC potential well or a pseudo-potential well; and/or (iii) changing a DC potential well to an extractive DC potential.

The method may comprise applying a DC voltage to said first and/or second arrays of electrodes in order to generate a DC potential well which acts to confine ions in a direction parallel to the surface of said first inner conical arrangement and/or parallel to the surface of said second outer conical arrangement.

Said DC potential well is preferably substantially symmetrical, quadratic or asymmetrical.

The method may comprise ejecting ions and causing said ions to separate according to their mass, mass to charge ratio or time of flight.

The method may comprise ejecting ions in a direction which is substantially orthogonal to the plane of the toroidal ion confining volume.

The method may comprise confining ions as a torus within said toroidal ion confining volume with a radius r1 and ejecting ions as a beam of ions with a radius r2, wherein $r2<r1$.

The method may comprise either: (i) pulsing a DC electric field in order to cause ions to be ejected; and/or (ii) applying one or more DC extraction potentials in order to cause ions to be ejected.

The method may comprise reacting or fragmenting ions within said toroidal ion confining volume.

The method may comprise providing an ion-optical device downstream of said toroidal ion confining volume; and ejecting ions from said toroidal ion confining volume into said ion-optical device. The ion-optical device optionally comprises a Time of Flight mass analyser, an ion mobility spectrometer or separator or an electrostatic ion trap or mass analyser.

The present invention also provides a method of mass and/or ion mobility spectrometry comprising:

trapping ions in a toroidal or annular ion confining volume defined between two spaced apart substantially parallel arrays of electrodes;

generating a DC potential well which acts to confine ions within said toroidal or annular ion confining volume in a direction that is substantially parallel to said arrays, wherein each array comprises a plurality of electrodes arranged between two edges of the array, and wherein said DC potential well acts to confine ions in a direction between said two edges of each array; and non-mass selectively ejecting ions from said toroidal or annular ion confining volume.

Preferably, the electrodes in each array of electrodes are arranged in side-by side arrangement between two edges of the array, and wherein the electrodes are arranged parallel to the two edges of the array or extending in a direction between the two edges of the array.

The arrays of electrodes preferably define a toroidal or annular ion confining volume that extends around a central axis of the device, and said two edges of each array are a radially inner edge and a radially outer edge.

The method preferably comprises applying one or more RF or AC voltages to said electrodes in order to confine ions in a direction extending substantially perpendicular to each of said arrays of electrodes and in a direction extending between said arrays of electrodes.

One or both of the arrays of electrodes may be substantially flat or planar.

One and/or both of the arrays of electrodes is preferably annular, circular or disc shaped.

One and/or both of the arrays of electrodes may be curved, tubular or conical structure.

Each of the parallel arrays of electrodes may be tubular or conical and one of the arrays of electrodes may be arranged concentrically within the other array of electrodes so as to define said toroidal or annular ion confining volume therebetween.

The central axes of the tubular or conical arrays are preferably coaxial and the method may comprise applying one or more RF or AC voltages to said electrodes in order to confine ions in a direction extending substantially radially from said central axes.

Each array of electrodes may have two edges and said two edges may be arranged at different locations along the central axes.

The central axes of the tubular or conical arrays are preferably coaxial and said DC potential well may act to confines ions in a direction extending along said central axes.

The tubular or conical arrays preferably taper from a wider end to a narrower end, and the method may comprise ejecting ions from said ion confining volume in a direction that is substantially perpendicular to a direction extending from one of said arrays to the other of said arrays, and in a direction that is from said wider end to said narrower end.

The method may comprise ejecting ions from said ion confining volume in a direction that is substantially perpendicular to a direction extending from one of said arrays to the other of said arrays.

Said DC potential well preferably confines ions within said toroidal or annular ion confining volume in a direction that is substantially perpendicular to a direction extending from one said arrays to the other of said arrays.

Said plurality of electrodes, or said arrays of electrodes, preferably define a toroidal or annular ion confining volume that extends around a central axis of the device, and said DC potential well preferably acts to confine ions in a direction extending radially from said central axis.

Said plurality of electrodes, or each array of electrodes, preferably comprises a plurality of closed loop, circular, annular, oval or elliptical electrodes.

The plurality of electrodes, or the electrodes in each array, preferably extend around a common central axis.

As discussed above, the toroidal or annular trapping region may extend around a central axis and the different ones of the plurality of electrodes may be arranged at different distances from the central axis.

In the embodiments wherein the arrays of electrodes are tubular or conical, the closed loop, annular, circular, oval or elliptical electrodes are preferably displaced from each other along the central axis of each tubular or conical array.

The method preferably non-mass selectively ejects ions from an exit of the ion trap by removing said DC potential well, or removing a portion of the DC potential well between the ions and the exit, and then applying one or more electrical potentials to electrodes that drive the ions out of said ion confining volume and out of said exit. Said one or more electrical potentials preferably form a DC potential gradient that drives the ions out of the exit.

The one or more electrical potentials that drive the ions out of said exit form an ion extraction field. These potentials are preferably applied to said plurality of electrodes, or to said arrays of electrodes. The ion extraction field is preferably a DC extraction field.

The extraction field preferably drives ions radially inwards towards the central axis of the device, i.e. at least a component of the motion of the ejected ions in towards the central axis.

Preferably, substantially all ions within the ion trap are ejected from the ion trap at substantially the same time or in the same ion ejection pulse; and/or ions having a range of different mass to charge ratios are ejected from the ion trap at substantially the same time; and/or ions having a range of different mass to charge ratios are ejected from the ion trap at substantially the same time, wherein the ratio of the maximum mass to charge ratio ejected to the minimum mass to charge ratio ejected is selected from: >1.1; >1.2; >1.4; >1.6; >1.8; >2; >2.5; >3; >4; >5; or >10.

Preferably, ions ejected from the ion trap are directed into a downstream ion guide, ion trap, mass or ion mobility analyser; or are directed onto a detector.

From a third aspect the present invention provides an ion trap comprising:

a plurality of electrodes which define a toroidal or annular ion confining volume that extends around a central axis; and a first device arranged and adapted to apply one or more voltages to said plurality of electrodes in order to generate a potential well which acts to confine ions in within said toroidal or annular ion confining volume.

The ion trap may have any one, or any combination of any two or more, features described above in relation to the first or second aspects of the present invention.

The ion trap may comprise a control system arranged and adapted to non-mass selectively eject ions from said toroidal or annular ion confining volume.

The potential well may be a DC potential well.

The potential well may confine ions in a radial direction, preferably wherein said radial direction is substantially perpendicular to said central axis.

From a fourth aspect the present invention provides an ion trap comprising:

two substantially parallel arrays of electrodes which are spaced apart so as to define a toroidal or annular ion confining volume therebetween; and a device arranged and adapted to apply one or more voltages to said electrodes in order to generate a potential well which acts to confine ions within said toroidal or annular ion confining volume, wherein each array comprises a plurality of electrodes arranged between two edges of the array, and wherein said DC potential well acts to confine ions in a direction between said two edges of each array.

The ion trap may have any one, or any combination of any two or more, features described above in relation to the first or second aspect of the present invention.

The potential well may be a DC potential well.

The potential well preferably acts to confine ions within said toroidal or annular ion confining volume in a direction that is substantially parallel to said arrays, wherein each array comprises a plurality of electrodes arranged between two edges of the array, and wherein said DC potential well acts to confine ions in a direction between said two edges of each array.

The ion trap may comprise a control system arranged and adapted to non-mass selectively eject ions from said toroidal or annular ion confining volume.

The present invention may also provide a reaction or fragmentation device comprising an ion trap according to said third and fourth aspects.

The present invention may also provide a mass and/or ion mobility spectrometer comprising an ion trap or a reaction or fragmentation device as described above.

The present invention may also provide methods of mass and/or ion mobility spectrometry comprising such a mass and/or ion mobility spectrometer.

The present invention also provides a mass spectrometer comprising:

a toroidal ion trap comprising a first array of electrodes and a second array of electrodes with a toroidal ion confining volume arranged therebetween;

an ion-optical device arranged downstream of said toroidal ion trap; and a control system arranged and adapted to cause at least some of said ions to be non-mass selectively ejected from said toroidal ion confining volume into said ion-optical device.

The ion-optical device may comprise a Time of Flight mass analyser, an ion mobility spectrometer or separator or an electrostatic ion trap or mass analyser.

The present invention also provides a method of mass spectrometry comprising:

trapping ions in a toroidal ion confining volume; and then non-mass selectively ejecting at least some of said ions from said ion confining volume into an ion-optical device.

The ion-optical device may comprise a Time of Flight mass analyser, an ion mobility spectrometer or separator or an electrostatic ion trap or mass analyser.

The spectrometer described herein may comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The spectrometer may comprise either:

(i) a C-trap and an Orbitrap™ mass analyser comprising an outer barrel-like electrode and a coaxial inner spindle-like electrode, wherein in a first mode of operation ions are transmitted to the C-trap and are then injected into the Orbitrap™ mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap™ mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage preferably has an amplitude selected from the group consisting of: (i)<50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i)<100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

A particularly preferred feature of the ion trap is that the ions which are ejected from the ion trap are preferably focused as they are ejected to occupy a smaller ion confinement volume than that of the ion trap. This is particularly advantageous for coupling the ion trap to a mass analyser. The ions also preferably emerge from the ion trap in an axial direction, in contrast to the arrangement disclosed in FIGS. 11A and 11B of WO 2013/027054.

The present invention is particularly advantageous in that it enables a large volume of ions to be simultaneously ejected from the ion trap and be focused and injected into a downstream ion-optical device, such as a Time of Flight mass analyser or an electrostatic ion trap or mass analyser, in a very short period of time. This is not possible with the arrangement disclosed in WO 2013/027054.

According to a feature of the present invention there is provided a high capacity toroidal or annular ion trap or ion trapping region in which ions are randomly distributed. Ions are preferably simultaneously ejected outside of the trapping region with trajectories such that ions from different locations in the trap substantially converge to a radius or volume which is smaller than the initial trapping radius or volume.

The trapping field may be removed during ion ejection and/or the ions may be ejected by rapid application of a pulsed DC acceleration field.

The preferred device may be used to generate a pulsed source of ions for a downstream analyser, such as a Time of Flight mass analyser, an ion mobility spectrometer or separator ("IMS") or an electrostatic ion trap.

The preferred embodiment provides a much larger capacity ion storage device which is inherently capable of focusing ejected ions in a way suitable for injection into an electrostatic ion trap or a multi reflection Time of Flight mass analyser.

In addition, the toroidal design does not suffer from distortions in the trapped ion cloud due to distortions in the trapping field at the entrance and exit end of the device as is the case with other known arrangements.

The open electrode structure according to the preferred embodiment in which ions are trapped in one direction by an RF confining field and in a radial direction by a DC potential well allows the ion trap to be constructed with an open geometry. This allows ions to be easily introduced and ejected compared with other known arrangements.

The preferred device preferably comprises a toroidal trapping volume in which ions are confined in a first direction by an RF confining field and in a second radial direction by a DC confining field.

The preferred embodiment preferably has the advantage of having a very high charge capacity compared to a linear or 3D ion trap but also provides an open electrode structure allowing ions to be easily injected between the two RF confining surfaces into a DC trapping region.

Trapped ions are preferably free to take up positions anywhere within the toroidal ion trapping volume and the ions are preferably reduced in kinetic energy or are otherwise cooled by collision with residual gas molecules.

Trapped ions may be rapidly accelerated in a non-mass selective manner out of the trapping region by application of a DC acceleration field acting towards the centre of the torus. The nature of the annular design is preferably such that ions substantially converge to a radius or volume which is less than the volume or radius of the ion trap. This characteristic preferably makes this device ideal for conditioning and periodically delivering large populations of ions to an analytical device, such as an electrostatic ion trap or a Time of Flight mass analyser or an ion mobility analyser, which requires a focused population of ions at an ion entrance.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

Figure 1A:
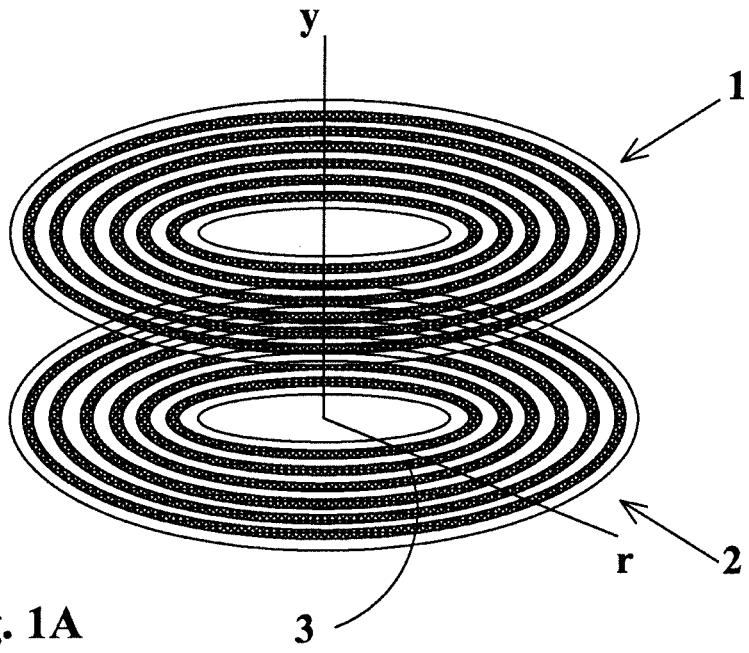
FIG. 1A shows a toroidal ion trap according to an embodiment of the present invention and FIG. 1B shows the ion trap in cross-section during an ion trapping mode.

FIG. 1A shows a perspective view of a device according to a preferred embodiment of the present invention. A toroidal ion trap is shown and comprises an upper planar electrode plate or array 1 and a corresponding lower planar electrode plate or array 2. The central axes of the electrode plates are aligned so as to form a central axis of the toroidal ion trap that extends in the y-direction. The electrode plates extend radially outwards from the central axis, in the radial direction r, in planes that are perpendicular to the central axis. The electrode plates 1,2 are preferably constructed from Printed Circuit Board ("PCB") material. Each of the electrode plates 1,2 is preferably annular in shape and preferably has a hole at the centre, through which the central axis of the ion trap extends.

In order to fill the ion trap with ions, an ion beam is preferably arranged to be incident upon the ion trap in a direction as indicated by arrow 3. This direction may be substantially perpendicular to the radial direction of the ion trap. The circumferentially open structure provided by the planar electrode plates 1,2 allows ions to be easily injected between the electrodes plates 1,2 and into one or more confining DC potential wells that are set up by the electrode plates, as will be described with reference to FIG. 1B. Ions are preferably injected into the ion trap in a direction that is substantially perpendicular to the radial direction of the ion trap, or substantially tangentially to the toroidal ion trapping volume, so that ions are preferably given the maximum time to cool or lose kinetic energy due to collisions with residual buffer gas present in the device as they enter the DC confining field.

Figure 1B:
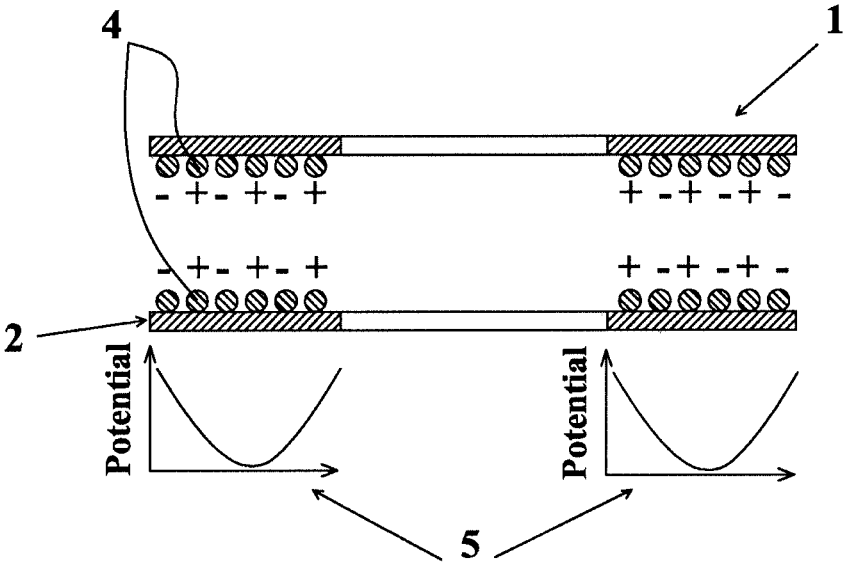

FIG. 1B shows a cross-sectional view in the (y,r) plane of the device shown in FIG. 1A. The inwardly facing sides of the upper and lower electrode plates 1,2 comprise annular electrodes 4. The annular electrodes extend around the central axis in a plane perpendicular to the central axis. Each plate preferably comprises a plurality of annular electrodes 4 having different radii from the central axis, wherein the annular electrodes 4 are concentrically arranged on the electrode plates 1,2. The electrodes 4 preferably form concentric strips which are attached to the PCB substrate. Radially adjacent annular electrodes 4 are preferably supplied with opposite phases of an alternating voltage that oscillates at radio frequency RF. Annular electrodes 4 at the same radial position on the electrode plates 1,2 are preferably supplied with the same phase of the RF voltage. The RF voltage serves to provide a pseudo-potential ion confinement field that confines ions in the y-direction, i.e. in a direction between the electrode plates 1,2.

Ions are preferably confined in the radial direction r by application of DC confining voltages to the electrodes 4. The general form of the preferred DC confining potential is indicated on the plots of potential versus distance shown in FIG. 1B. The potentials is preferably substantially quadratic in the radial direction, with the minimum potential arranged between the inner and outer circumferential edges of the electrode plates 1,2. This may be achieved by applying minimum DC voltages to the radially centred electrodes 4 arranged on the electrode plates 1,2; applying progressively higher DC voltages to the electrodes 4 located at radial positions that progressively increase from the centred electrodes 4; and applying progressively higher DC voltages to the electrodes 4 located at radial positions that progressively decrease from the centred electrodes 4. It is contemplated that the DC potential may take any form, as long as there is at least one potential minima formed to confine ions radially in a torus about the central axis. During filling of the ion trap it may be advantageous to generate a radially asymmetric DC potential well such that the side of the potential well is shallower on the ion input side of the torus (i.e. radially outer side) as compared to the radially inner side of the torus.

Figure 2A:
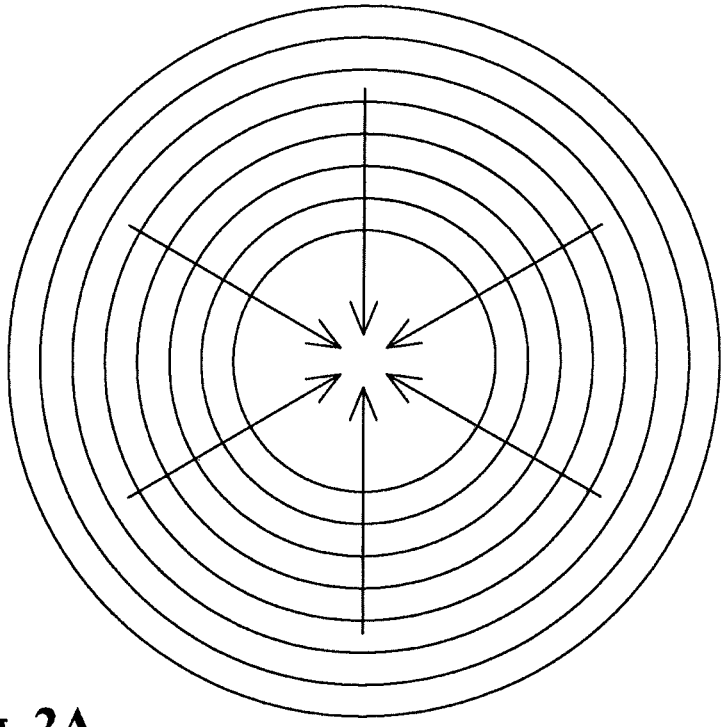
FIG. 2A shows a plan view of the ion trap and FIG. 2B shows a cross-sectional view during an ion extraction mode.

FIG. 2A shows a plan view of the device shown in FIGS. 1A and 1B. The direction of ion extraction is indicated by the arrows.

Figure 2B:
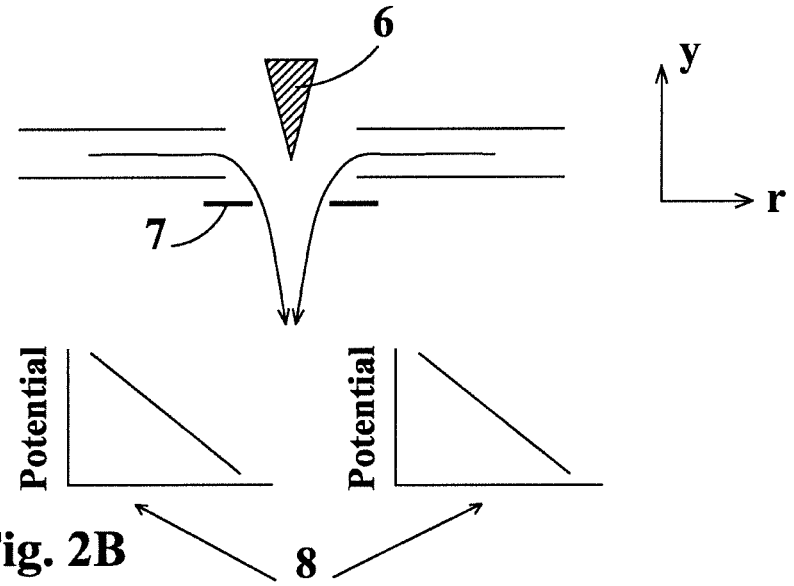

FIG. 2B shows a cross-sectional view of the device in the y-r plane during rapid extraction of ions from the device. Once ions have been introduced into and trapped in the ion trap they are allowed to reduce in energy due to collisions with background buffer gas. The ions are then extracted by the device. In order to achieve this, the RF confining potential is preferably turned off or reduced, and a DC extraction potential is preferably applied so as to accelerate ions out of the trapping region towards a point at the centre of the device. The DC extraction potential is formed by applying DC potentials to the annular electrodes 4. The DC potentials applied to the electrodes 4 progressively increase with increasing radial position so as to create a potential gradient that accelerates the ions radially inwards. The general form of the extraction potential is shown in the plots of potential versus distance 8.

The radial symmetry of the device preferably results in ions being accelerated to a single point at the centre of the device. An ion deflection electrode 6 is preferably arranged at the radial centre of the device and may extend through the aperture in one of the electrode plates 1. An electrical potential is applied to this deflection electrode so as to force ions away and cause the ions to move along the central axis y. Alternatively, or additionally, an extraction electrode 7 may be situated at the centre of the device, preferably outside of the electrode plates. An electrical potential is applied to this deflection electrode so as to attract ions to move along the along the central axis y. The potentials applied to the deflection and/or extraction electrodes 6,7 preferably result in ions being directed along the central axis y in a direction substantially orthogonal to the plane of the trapping device, i.e. the radial direction. The ions may advantageously separate by their time of flight during this extraction process, e.g. according to their mass to charge ratios or ion mobilities. The ions may then be ejected onto a detector or into a mass analyser, such as a Time of Flight mass analyser. Alternatively, the ions may be ejected into another device, such as an electrostatic ion trap.

Figure 3A:
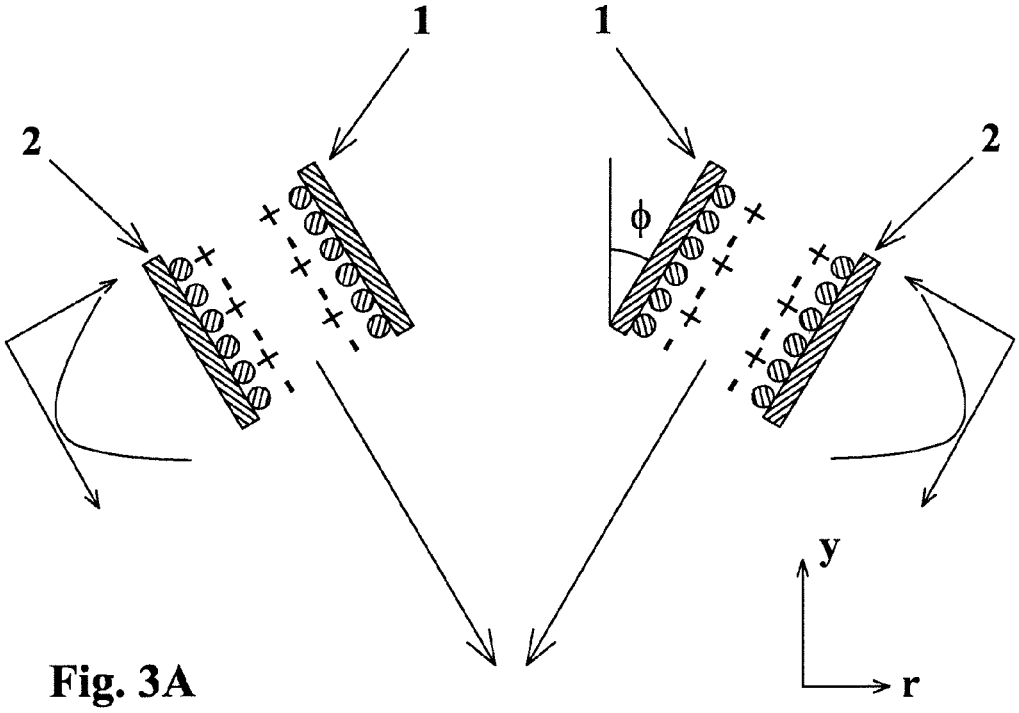
FIG. 3A shows a cross-sectional view of an ion trap according to an alternative embodiment and FIG. 3B shows a perspective view of the trapping electrodes.
Figure 3B:
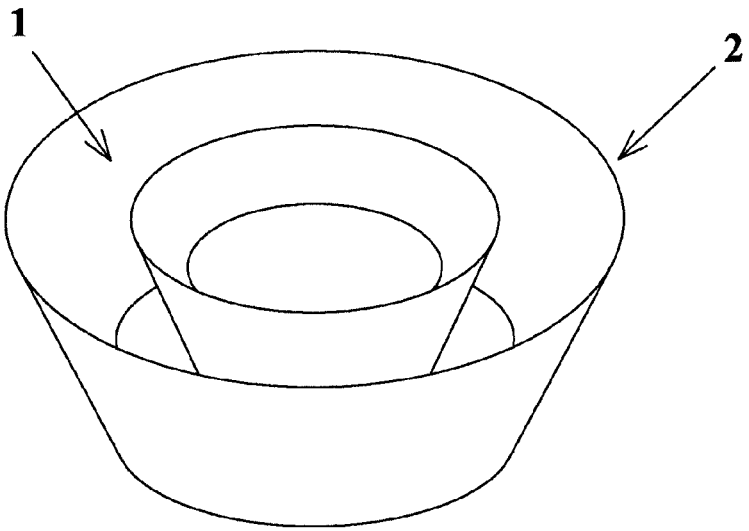

FIGS. 3A and 3B show views of an alternative embodiment wherein the parallel planar electrode plates 1,2 of FIGS. 1A to 2B are replaced by concentric conical or tubular electrode members 1,2.

FIG. 3B shows a perspective view of the ion trap. A toroidal ion trap is shown and comprises an inner conical electrode member 1 surrounded by an outer conical electrode member 2. The central axes of the conical electrode members are aligned so as to form a central axis of the toroidal ion trap that extends in the y-direction. The conical electrode members 1,2 are preferably constructed from Printed Circuit Board ("PCB") material.

FIG. 3A shows a cross-sectional view in the y-r plane of the device shown in FIG. 3B. The radially outward facing side of the inner conical electrode member 1 comprises a plurality of annular electrodes 4 that extend circumferentially around the inner conical electrode member 1. As shown in FIG. 3A, different annular electrodes 4 are provided around the conical electrode member 1 at different axial positions along the central axis. The radially inward facing side of the outer conical electrode member 2 also comprises a plurality of annular electrodes 4 that extend circumferentially around the outer conical electrode member 2. Different annular electrodes 4 are provided around the conical electrode member 2 at different axial positions along the central axis. The electrodes 4 preferably form concentric strips which are attached to the PCB substrate.

Adjacent annular electrodes 4 on any given conical electrode member 1,2 are preferably supplied with opposite phases of an alternating voltage that oscillates at radio frequency RF. The RF voltage serves to provide a pseudo-potential ion confinement field that confines ions in a first direction between the conical electrode members 1,2.

Ions are preferably confined between the conical electrode members 1,2 in a second direction that is perpendicular to the direction extending between the conical electrode members 1,2 by application of DC confining voltages to the electrodes 4. The general form of the preferred DC confining potential is indicated on the plots of potential versus distance shown in FIG. 3A. The potential is preferably substantially quadratic in the second direction, with the minimum potential arranged between the upper and lower edges of the conical electrode members 1,2. It is contemplated that the DC potential may take any form, as long as there is at least one potential minima formed to confine ions radially in a torus about the central axis. During filling of the ion trap it may be advantageous to generate an asymmetric DC potential well such that the side of the potential well is shallower on the ion input side as compared to the other side.

According to this embodiment the conical electrode members 1,2 are preferably angled relative to the central axis so as to form concentric cone like structures. Ions may be injected and extracted in similar manners to those described above in relation to the embodiment shown in FIGS. 1 and 2. However, an advantage of the angled cone like configuration is that when the ions are ejected from different positions around the circumference of the torus, the ions are directed towards the same focal point arranged along the central axis of the device. This is shown by the arrows in FIG. 3A. Ions will be focused to substantially the same point in space without the need for deflection or extraction electrodes. The distance from the centre of the trapping structure to this focal point can be selected by selecting the angle $\phi$ shown in FIG. 3A, i.e. the angle between the second direction and the central axis.

Although the present invention has been described with reference to preferred embodiments, it will be understood by those skilled in the art that various changes in form and detail may be made without departing from the scope of the invention as set forth in the accompanying claims.

For example, the electrode structure need not be circular around the central axis, but may take the form of other shapes.

It is contemplated that the device may be used as a reaction or fragmentation cell.

Although a DC confining well has been described having only one minima, it is contemplated that more than one DC confining well may be provided.

The invention claimed is:

1. An ion trap comprising:

a plurality of electrodes which define a toroidal or annular ion confining volume that extends around a central axis;

a first device arranged and adapted to apply one or more DC voltages to said plurality of electrodes in order to generate a DC potential well which acts to confine ions in a radial direction within said toroidal or annular ion confining volume, wherein said radial direction is substantially perpendicular to said central axis; and a control system arranged and adapted to non-mass selectively eject ions from said toroidal or annular ion confining volume.

2. An ion trap comprising:

two substantially parallel arrays of electrodes which are spaced apart so as to define a toroidal or annular ion confining volume therebetween;

a device arranged and adapted to apply one or more DC voltages to said electrodes in order to generate a DC potential well which acts to confine ions within said toroidal or annular ion confining volume in a direction that is substantially parallel to said arrays, wherein each array comprises a plurality of electrodes arranged between two edges of the array, and wherein said DC potential well acts to confine ions in a direction between said two edges of each array; and a control system arranged and adapted to non-mass selectively eject ions from said toroidal or annular ion confining volume.

3. An ion trap as claimed in claim 2, wherein the electrodes in each array of electrodes are arranged in side-by side arrangement between two edges of the array, and wherein the electrodes are arranged parallel to the two edges of the array or extending in a direction between the two edges of the array; wherein said arrays of electrodes define a toroidal or annular ion confining volume that extends around a central axis of the device, and wherein said two edges of each array are a radially inner edge and a radially outer edge.

4. An ion trap as claimed in claim 2, wherein each of the parallel arrays of electrodes is tubular or conical and one of the arrays of electrodes is arranged concentrically within the other array of electrodes so as to define said toroidal or annular ion confining volume therebetween; and wherein at least one of:

a) the central axes of the tubular or conical arrays are coaxial and the ion trap comprises a device for applying one or more RF or AC voltages to said electrodes in order to confine ions in a direction extending substantially radially from said central axes;

b) each array of electrodes has a central axis and two edges, and said two edges are arranged at different locations along the central axis;

c) the central axes of the tubular or conical arrays are coaxial and said DC potential well acts to confine ions in a direction extending along said central axes; and d) the tubular or conical arrays taper from a wider end to a narrower end, and wherein ions are ejected from said ion confining volume in a direction that is substantially perpendicular to a direction extending from one of said arrays to the other of said arrays, and in a direction that is from said wider end to said narrower end.

5. An ion trap as claimed in claim 2, wherein said plurality of electrodes comprises a plurality of closed loop, circular, annular, oval or elliptical electrodes.

6. An ion trap as claimed in claim 2, wherein said control system non-mass selectively ejects ions through an exit of the ion trap by removing said DC potential well, or removing a portion of the DC potential well between the ions and the exit, and then applying one or more electrical potentials to electrodes that drive the ions out of said ion confining volume and out of said exit.

7. An ion trap as claimed in claim 6, wherein said one or more electrical potentials form a DC potential gradient that drives the ions out of the exit.

8. An ion trap as claimed in claim 2, wherein substantially all ions within the ion trap are ejected from the ion trap at substantially the same time or in the same ion ejection pulse; or wherein ions having a range of different mass to charge ratios are ejected from the ion trap at substantially the same time or in the same ion ejection pulse; or wherein ions having a range of different mass to charge ratios are ejected from the ion trap at substantially the same time or in the same ion ejection pulse, wherein the ratio of the maximum mass to charge ratio ejected to the minimum mass to charge ratio ejected is selected from: >1.1; >1.2; >1.4; >1.6; >1.8; >2; >2.5; >3; >4; >5; or >10.

9. An ion trap as claimed in claim 2, wherein said control system is arranged and adapted to eject ions from said toroidal or annular ion confining volume so that said ions are focused to an ion volume which is smaller than said toroidal or annular ion confining volume.

10. An ion trap as claimed in claim 2, wherein said toroidal or annular trapping region extends around a central axis, and wherein said control system is arranged and adapted to cause ions which have been non-mass selectively ejected from said toroidal or annular ion confining volume to emerge axially from said ion trap along said central axis; and wherein at least one of:

a) said trap comprises one or more deflection electrodes or one or more extraction electrodes arranged to cause ions to exit the ion trap along said central axis; and b) said toroidal or annular trapping region is arranged in a first plane, and wherein said one or more deflection electrodes is arranged on one side of said first plane or said one or more extraction electrodes is arranged on the other side of said first plane.

11. An ion trap as claimed in claim 2, wherein the plurality of electrodes comprises a first and second array of electrodes, wherein said first array of electrodes is arranged in a first inner conical arrangement and said second array of electrodes is arranged in a second outer conical arrangement.

12. An ion trap as claimed in claim 11, comprising a device arranged and adapted to apply a RF voltage to said first or second array of electrodes in order to generate a pseudo-potential well which acts to confine ions in a direction substantially perpendicular to the surface of said first inner conical arrangement or substantially perpendicular to the surface of said second outer conical arrangement within said ion trap; or wherein said device is arranged and adapted to apply a DC voltage to said first or second arrays of electrodes in order to generate the DC potential well which acts to confine ions in a direction parallel to the surface of said first inner conical arrangement or parallel to the surface of said second outer conical arrangement within said ion trap.

13. An ion trap as claimed in claim 2, wherein said control system is arranged and adapted to extract ions from said ion trap by either: (i) reducing or altering the amplitude of a DC or RF voltage applied to said plurality of electrodes; or (ii) lowering, removing or altering a DC potential well or a pseudo-potential well; or (iii) changing a DC potential well to an extractive DC potential.

14. An ion trap as claimed in claim 2, wherein during an ejection mode of operation ions ejected from said ion trap are caused to separate according to their mass, mass to charge ratio or time of flight.

15. An ion trap as claimed in claim 2, wherein said control system is arranged and adapted:

(i) to pulse a DC electric field in order to cause ions to be ejected from said ion trap; or (ii) to apply one or more DC extraction potentials to said ion trap in order to cause ions to be ejected from said ion trap.

16. A mass or ion mobility spectrometer comprising an ion trap or a reaction or fragmentation device as claimed in claim 2.

17. A method of mass or ion mobility spectrometry comprising:

trapping ions in a toroidal or annular ion confining volume that extends around a central axis;

generating a DC potential well which acts to confine ions in a radial direction within said toroidal or annular ion confining volume, wherein said radial direction is substantially perpendicular to said central axis; and non-mass selectively ejecting ions from said toroidal ion confining volume.

18. A method of mass or ion mobility spectrometry comprising:

trapping ions in a toroidal or annular ion confining volume defined between two spaced apart substantially parallel arrays of electrodes;

generating a DC potential well which acts to confine ions within said toroidal or annular ion confining volume in a direction that is substantially parallel to said arrays, wherein each array comprises a plurality of electrodes arranged between two edges of the array, and wherein said DC potential well acts to confine ions in a direction between said two edges of each array; and non-mass selectively ejecting ions from said toroidal or annular ion confining volume.

19. A mass spectrometer comprising:

a toroidal ion trap comprising a first array of electrodes and a second array of electrodes with a toroidal ion confining volume arranged therebetween;

an ion-optical device arranged downstream of said toroidal ion trap; and a control system arranged and adapted to cause at least some of said ions to be non-mass selectively ejected from said toroidal ion confining volume into said ion-optical device.

20. A method of mass spectrometry comprising:

trapping ions in a toroidal ion confining volume; and then non-mass selectively ejecting at least some of said ions from said ion confining volume into an ion-optical device.

* * * * *